US006357086B1

(12) United States Patent
Ye

(10) Patent No.: US 6,357,086 B1
(45) Date of Patent: Mar. 19, 2002

(54) ZIPPER LOCK AND EXTENSION

(76) Inventor: Mark Changfeng Ye, 3850 St. Elisabeth Sq., Duluth, GA (US) 30096

( * ) Notice: Subject to any disclaimer, the term of this patent is extended or adjusted under 35 U.S.C. 154(b) by 0 days.

(21) Appl. No.: 09/464,838

(22) Filed: Dec. 16, 1999

Related U.S. Application Data

(63) Continuation-in-part of application No. 09/333,558, filed on Jun. 16, 1999, now Pat. No. 6,105,213.

(51) Int. Cl.[7] ..... A44B 19/00

(52) U.S. Cl. ..... 24/381; 24/386; 24/390; 24/429

(58) Field of Search ..... 24/385, 381, 382, 24/383, 384, 386, 429, 580–585, 372, 573.1, 573.2, 573.3, 573.5, 573.7, 108, 387, 390, 16 PB, 662, 664, 665, 671, 672; 70/68; 292/307 R, 317; 190/120, 903

(56) References Cited

U.S. PATENT DOCUMENTS

| | | | | |
|---|---|---|---|---|
| 231,048 | A | * | 8/1880 | Ives |
| 280,554 | A | * | 7/1883 | Banks |
| 1,073,714 | A | * | 9/1913 | Shorten |
| 1,278,783 | A | * | 9/1918 | Stoner |
| 1,344,816 | A | * | 6/1920 | Passage |
| 1,663,621 | A | * | 3/1928 | Bowman |
| 4,027,361 | A | * | 6/1977 | Yoneya |
| 4,123,829 | A | * | 11/1978 | Takabatake |
| 4,466,162 | A | * | 8/1984 | Pogharian et al. |
| 4,672,725 | A | * | 6/1987 | Kasai |
| 4,970,766 | A | * | 11/1990 | Hsiau et al. |
| 5,136,758 | A | * | 8/1992 | Wilcox et al. |
| 5,427,562 | A | * | 6/1995 | Hwang |
| 5,535,491 | A | * | 7/1996 | Allport |
| 6,105,213 | A | * | 8/2000 | Ye |

FOREIGN PATENT DOCUMENTS

| | | |
|---|---|---|
| IT | 452704 | * 10/1949 |

* cited by examiner

*Primary Examiner*—James R. Brittain
(74) *Attorney, Agent, or Firm*—Bernstein & Associates, P.C.; Jason A. Bernstein

(57) ABSTRACT

A first extension member has a head coupled to a first zipper head and a tail having a male connector and an elongated generally flat intermediate portion between the head and the male connector. A second extension member has a head coupled to a second zipper head and a body with a female connector that receives and locks the male connector and receives and permits free sliding movement of the elongated flat intermediate portion.

The female connector prevents removal of the male connector therefrom to prevent opening the zipper beyond a predetermined position based on the length of the elongated intermediate portion. Because the male connector is positioned generally at the end of the tail and the elongated intermediate portion is generally flat, the tail may slide freely within the female connector between the head and the male connector so that the zipper is therefore not locked in any fixed position.

3 Claims, 3 Drawing Sheets

ZIPPER LOCK AND EXTENSION

CROSS-REFERENCE TO RELATED APPLICATION

This application is a continuation-in-part of U.S. patent application Ser. No. 09/333,558, filed Jun. 16, 1999, now U.S. Pat. No. 6,105,213, which is hereby incorporated by reference in its entirety.

FIELD OF THE INVENTION

The present invention relates generally to locking mechanisms, and more particularly, to a two-piece interlocking extension suitable for maintaining two zippers pulls in a spaced locked relationship until the mechanism is broken.

BACKGROUND OF THE INVENTION

Conventional zippers are used on a wide variety of articles to quickly and easily attach and detach two pieces of material such as fabrics, plastics, leather, synthetics, blends, and like materials. Conventional zippers have proved satisfactory in many applications where ready attachment and detachment is the only or primary objective, however, in some applications it is also highly desirable to provide a mechanism for locking the zipper in a closed position for security purposes.

One such application is the commercial display of articles such as comforters, quilts, blankets, linens, pillows, drapery, and the like. These articles are typically packaged in generally clear, lightweight plastic enclosures for shipping and sanitary purposes. The articles are commonly displayed in the clear enclosures to provide for visual inspection of the article contained therein by the potential customer and to also maintain the cleanliness of the article.

The use of conventional zippers in such applications provides the limited benefit of providing for ready opening and closing of the enclosure to access the article contained therein. In making a purchasing decision, potential customers often desire to touch as well as to view the article, especially comforters, linen, and other more "intimate" articles that often contact a person's skin. With conventional zippers, the potential customer can easily unzip and open the enclosure and reach therein to feel the article. However, potential customers sometimes will open the enclosure and remove the article therefrom, which can result in the article becoming dirty and unsanitary from handling, contacting the floor, and/or like contaminants. This is particularly undesirable for such "intimate articles" as discussed above.

Furthermore, there are an increasing number of instances where potential customers insert additional articles into the enclosures with such additional articles concealed to avoid paying for them. Potential customers have also inserted higher cost articles into enclosures from which they removed lower cost articles with pricing information provided on the enclosures to pay the lower price for the higher priced article.

In order to secure the articles within the enclosures, nylon cable straps are sometimes used to secure the zipper head or heads in the closed position. Such cables comprise a strap with a male end that is inserted through conventional zipper head apertures and looped back to be received by the opposite female end of the same strap. Such known cable straps require the use a cable gun to install the straps. Additionally, it is known to secure the zipper head apertures together by the use of tie straps made of a material such as metal wire, plastic, or the like. These known techniques provide the benefit of locking the zipper closed to prevent removal of the article from the enclosure, however, they also preclude the prospective customer from being able to touch the article to evaluate its softness, durability, quality of construction, and the like.

Accordingly, what is needed but not found in the prior art is a device which permits locking of a zipper on an enclosure to prevent access and/or removal of the article contained therein, that also permits limited access to the article for inspection thereof.

SUMMARY OF THE INVENTION

Generally described, the present invention provides a locking and extension device for a zipper on an enclosure, the zipper including a first head with an eyelet and a second head with an eyelet. The zipper and the locking and extension device are preferably made of nylon or the like.

In a first preferred embodiment of the present invention, there is provided a first extension member having a head and a tail. The first extension head preferably has an aperture that is coupled to the eyelet of the first zipper head. The tail has a male connector and an elongated intermediate portion between the head and the male connector. The male connector preferably has at least one generally triangular recess defined therein or rib defined thereon. The elongated intermediate member has a generally flat profile permitting the elongated intermediate member to freely slide within the channel of the female connector as described below.

There is provided a second extension member having a head and a body with a female connector. The second extension head preferably has an aperture that is coupled to the eyelet of the second zipper head. The first extension head and the second extension head preferably have approximately the same as the thickness. The female connector has a channel, a well adjacent to the channel, and an arm with at least one generally triangular tab extending therefrom. The arm is positioned within the well and the tab is positioned within the channel so that the channel is capable of receiving the male connector and the elongated portion of the tail and the tab is capable of preventing the male connector from being retracted from the channel.

A second preferred embodiment of the present invention provides a similar locking and extension device for a zipper. The second embodiment, however, has a shorter elongated intermediate member for use in applications with smaller enclosures.

A third preferred embodiment of the present invention provides a similar locking and extension device for a zipper. The third embodiment has a smooth bored channel extending through the female connector of the second extension member, and a male connector formed by at least one and preferably two ribs extending from the tail of the first extension member with a slot defined in the tail between the ribs.

A fourth preferred embodiment of the present invention provides a similar locking and extension device for a zipper. The fourth embodiment has a smooth bored channel extending into the female connector of the second extension member and a notch defined in an interior wall thereof, and a male connector formed by at least one rib extending from the tail of the first extension member.

For use of the present invention, the male connector is inserted into and through the female connector for locking together the first and second extension members. The zipper is then locked from being entirely opened because the female connector will not permit removal of the male connector therefrom.

Because the elongated intermediate portion is generally flat, it may slide freely within the female connector between the head and the male connector. The zipper heads may thus be moved to a generally closed position so that the enclosure may be generally closed during shipping to protect the article contained there from dirt, dust, and other contamination.

Because the male connector is positioned generally at the end of the first extension member and the elongated intermediate portion is generally flat, the zipper heads may then separated to partially open the enclosure during display. In this way, the first and second extension members act as movable extensions to the zipper to permit freely closing and opening the zipper up to a predetermined range. Thus, the zipper is not locked in any fixed position, but instead permitted to be partially opened or closed but never more than partially opened. The zipper therefore can not be accidentally locked in a closed position preventing the desired limited access to the article within the enclosure.

Accordingly, it is an object of the present invention to provide a two-piece lock and extension for a zipper that permits the zipper to be closed during shipping of the enclosure and also permits the zipper to be partially opened and closed yet locked from being more than partially opened during display of the enclosure.

It is another object to provide a male extension for connecting to a first zipper head and a female extension for connecting to a second zipper head, the female extension capable of receiving and locking the male extension such that the male extension can not be removed therefrom wherein the zipper is thereby locked.

It is still another object to provide a generally flat elongated portion of the male extension that is capable of sliding generally freely through the female extension so that the zipper may be partially opened or closed.

These and other objects, features, and advantages of the present invention are discussed or apparent in the following detailed description of the invention, in conjunction with the accompanying drawings and the appended claims.

BRIEF DESCRIPTION OF THE DRAWINGS

The various features and advantages of the invention will be apparent from the attached drawings, in which like reference characters designate the same or similar parts throughout the figures, and in which.

DETAILED DESCRIPTION OF THE PREFERRED EMBODIMENTS

Figure 1:
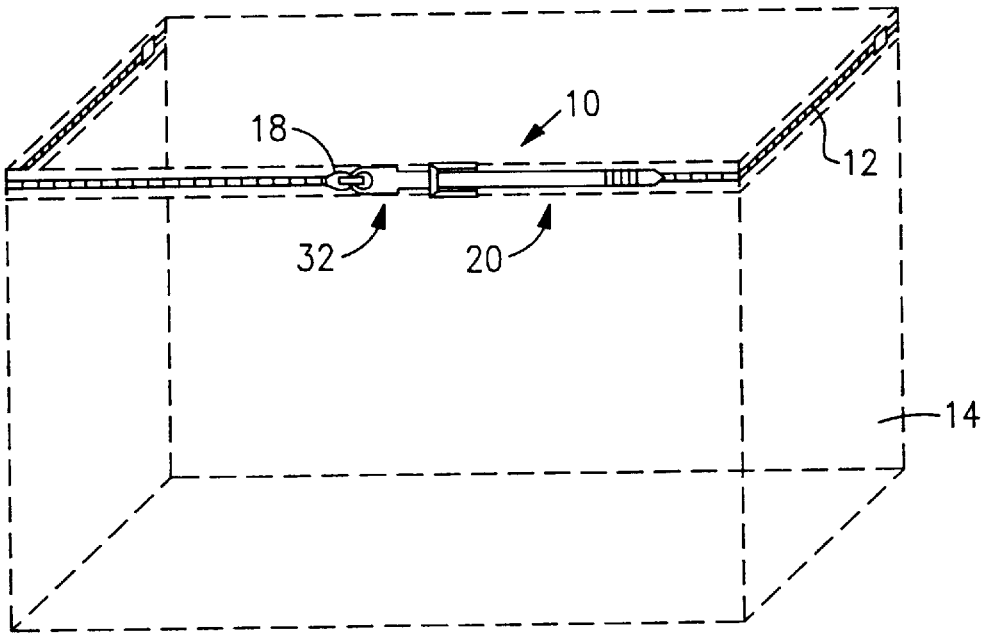
FIG. 1 is a perspective view of a first preferred embodiment of the present invention installed on an enclosure in a generally closed position.

Referring now to FIG. 1, there is illustrated a first preferred embodiment of the present invention, referred to generally as zipper lock 10. The zipper lock 10 is preferably used in conjunction with a zipper 12 on an enclosure 14 such as a generally clear, lightweight plastic enclosure for containing a comforter, quilt, blanket, linen, pillow, drapery, and/or other articles. It should be noted that the zipper lock 10 is described herein for use with the enclosure 14 by way of example only, and that the zipper lock 10 may be advantageously employed in any application where it is desirable to provide the capability of readily attaching and detaching two pieces of material.

The zipper 12 is preferably a conventional type including a first movable zipper head 16 with an eyelet 17 or the like and a second movable zipper head 18 with an eyelet 19 or the like. Optionally, the zipper lock 10 may be satisfactorily employed on a zipper 12 having the first movable zipper head 16 and a generally stationary member (not shown) with stationary eyelet or the like. The zipper heads 16 and 18 are preferably made of nylon, metal, plastic, composites, or other materials known to those skilled in the art.

Figure 2:
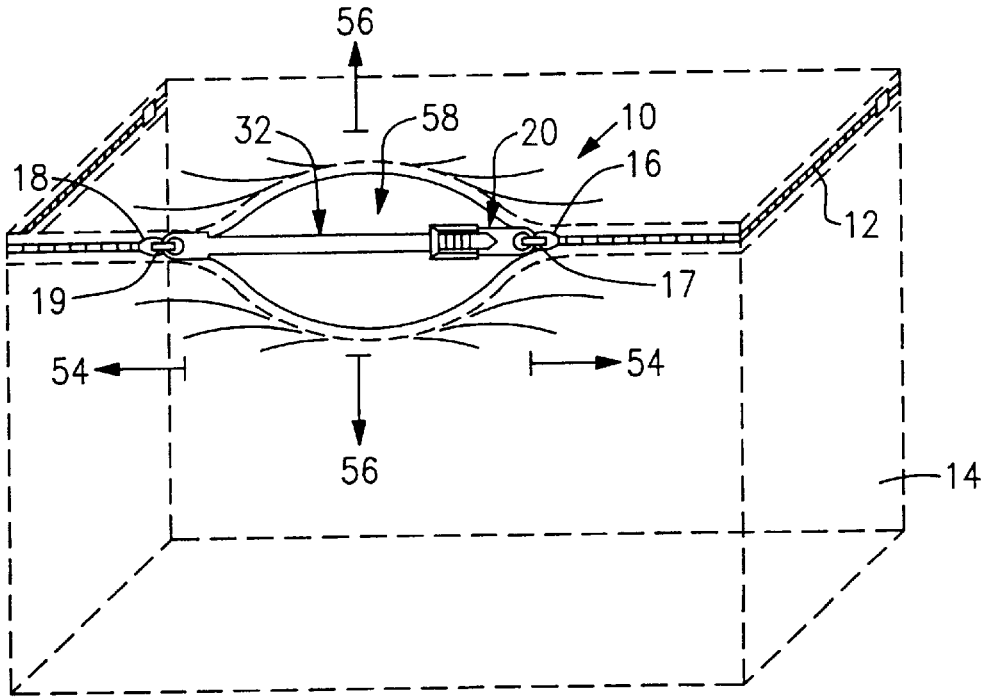
FIG. 2 is a perspective view of the present invention installed on the enclosure in a partially open position.
Figure 3:
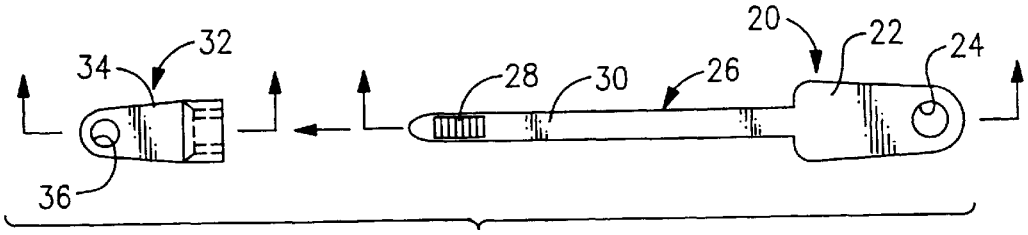
FIG. 3 is a top plan view of the first preferred embodiment.
Figure 4:
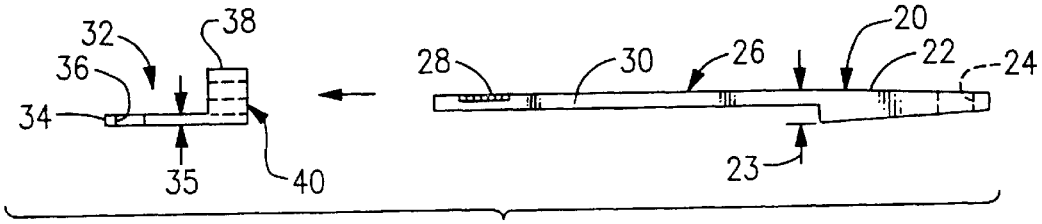
FIG. 4 is a side elevation view of FIG. 3.

Referring now to FIGS. 2–4, there is provided a first extension member 20 having a head 22 with an aperture 24 defined therein and having a tail 26 with a male connector 28 and an elongated intermediate portion 30. The aperture 24 is interconnected with the eyelet 17 of the first zipper head 16, preferably during the manufacturing process of the zipper 12 and/or of the zipper lock 10. The first extension member 20 thereby acts as an extension of the first zipper head 16.

A second extension member 32 is provided having a head 34 with an aperture 36 defined therein and having a body 38 with a female connector 40. The aperture 36 is interconnected with the eyelet 19 of the second zipper head 18, preferably during the manufacturing process of the zipper 12 and/or of the zipper lock 10. The second extension member 32 thereby acts as an extension of the second zipper head 18.

The first and second extension members 20 and 32 are preferably molded from nylon or the like. Optionally, the first and second extension members 20 and 32 may be made of plastic, metal, composite, mixtures thereof, or other material known to those skilled in the art, and may be made by other fabrication techniques as are known to those skilled in the art. Such material and fabrication method are preferably selected to provided a zipper lock 10 that is generally strong, lightweight, non-ductile, and capable of being cut by a conventional scissors or the like.

The female connector 40 of the second extension member 32 receives therethrough the male connector 28 of the first extension member 20. The male and female connectors 28 and 40 are of a type that permit the male connector 28 to be inserted into the female connector 40 and generally locked therein such that the male connector 28 can not be removed from the female connector 40, thereby securing together the first and second extension members 20 and 32. Because the male connector 28 is positioned generally at the end of the first extension member 20, the elongated intermediate portion 30 permits the zipper heads 16 and 18 to be separated to partially open the enclosure 14. In this way, the first and second extension members 20 and 32 act as extensions of the zipper heads 16 and 18. The length of the elongated portion 30 may be selected to provide the corresponding range of permissible separation of the zipper heads 16 and 18 as desired in a given application.

Furthermore, the tail 26 may then be further inserted through the female connector 40 so that the male connector 28 extends through the female connector 40 and the intermediate flat portion 30 of the tail 28 is then within the female connector 40. Because the intermediate portion 30 is flat, it may slide freely within the female connector 40 between the head 22 and the male connector 28. The zipper heads 16 and 18 may thus be moved between a generally closed position and a partially open position, without permanently locking the zipper heads 16 and 18 in either position but still locking the zipper heads 16 and 18 from further separation beyond the partially open position predetermined by the length of the elongated intermediate portion 30. Thus, the zipper 12 is not locked in any fixed position, but instead permitted to be partially opened or closed but never more than partially opened.

Figure 5:
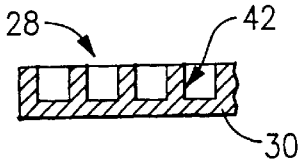
FIGS. 5–7 are detail side views of alternative male connectors of alternative embodiments of the present invention.
Figure 6:
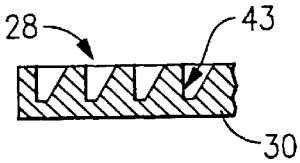
Figure 7:
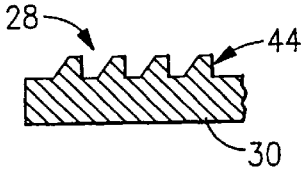

Referring now to FIGS. 5–7, there are illustrated alternative male connectors 28. FIG. 5 provides at least one generally rectangular recess 42 defined in the tail 30. FIG. 6 provides at least one generally triangular recess 43 defined in the tail 30. FIG. 7 provides at least one generally triangular rib 44 extending from the tail 30. Other indentations and/or projections as are known to those skilled in the art may be provided. There are preferably provided a plurality of recesses or ribs 42, 43, or 44 to serve as backups in the event of manufacturing irregularities, damage thereto, and/or slippage within the female connector 40. The generally triangular recesses 43 and ribs 44 are most advantageous for permitting the male connector 28 to be inserted into the female connector 40 and thereafter locked therein.

Figure 8:
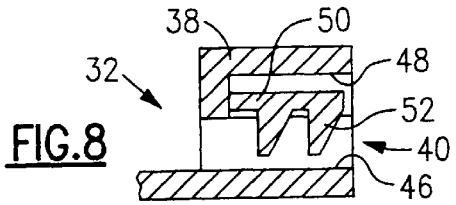
FIG. 8 is a detail side elevation view of the female connector of FIG. 3.
Figure 9:
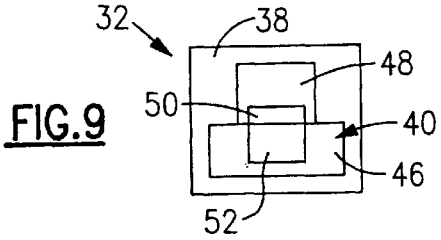
FIG. 9 is a detail front elevation view of the female connector of FIG. 3.

Referring now to FIGS. 8–9, there is illustrated the preferred female connector 40. A channel 46 is defined extending through the body 38 and a well 48 is defined extending into the body 38 and adjacent the channel 46. An arm 50 is arranged within and attached to the well 48 and at least one tab 52 extends from the arm 50. The tab 52 is sized and shaped to receive the recesses or ribs 42, 43, or 44 of the male connector 28. The arm 50 is positioned generally within the well 48 and the tab 52 extends generally downward into the channel 46. The arm 50 may be arranged generally axially aligned with the well 48 or at an angle relative to the well 48.

The male connector 28 may thereby be inserted into and through the female connector 40 for locking the first and second extension members 20 and 32 together. The tail 30 is inserted through the channel 46 so that the tab 52 engages the recesses or ribs 42, 43, or 44 to prevent removal thereafter of the male connector 28 therefrom. The first head 22 preferably has a thickness 23 that is approximately the same as a thickness 35 of the second head, the thicknesses 23 and 35 sufficient to slightly elevate the male connector 28 of the tail 26 and thereby generally align the male connector 28 with the channel 48.

The zipper 12 is not locked in any fixed position because the generally triangular recesses or ribs 43 for 44 when forced against the generally triangular tab 52 will shear the tab 52 upward into the well 48 thereby allowing the male connector 28 to advance through the female connector 40. The elongated flat portion 30 has no recesses 43 or 44 to engage the female connector 40, and may thus be freely slid therein. The male connector 28 can not be removed from the female connector 40 because the generally vertical surfaces of the recesses or ribs 43 or 44 will abut and not advance pass the generally vertical surfaces of the tabs 52. Where recesses 43 are employed, the tab 52 will engage a recess 43 and may not be further retracted, but the male connector 28 can always be advanced and thus is never locked in any fixed position. Where ribs 44 are employed, the tab 52 will abut a rib 44, but the male connector 28 can always be advanced and thus is never locked in any fixed position.

Figure 10:
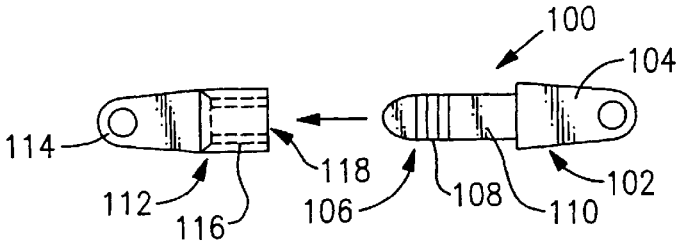
FIG. 10 is a top plan view of a second preferred embodiment of the present invention.

Referring now to FIG. 10, there is illustrated a second preferred embodiment of the present invention, providing a zipper lock 100 which is similar to the first embodiment. There is provided a first extension member 102 having a head 104 and a tail 106 with a male connector 108 and an elongated intermediate portion 110. A second extension member 112 is provided having a head 114 and a body 116 with a female connector 118. The female connector 118 receives and engages the male connector 108. The zipper lock 110 of the second embodiment is similar to the zipper lock 10 of the first embodiment, except that the elongated intermediate member 110 of the second embodiment is generally shorter and provided for applications where it is desirable to have a shorter range of permissible separation of the zipper heads 16 and 18. Such applications may include where there is used a relatively smaller enclosure 14 for relatively smaller articles such as pillow cases, certain linens, and the like.

Figure 11:
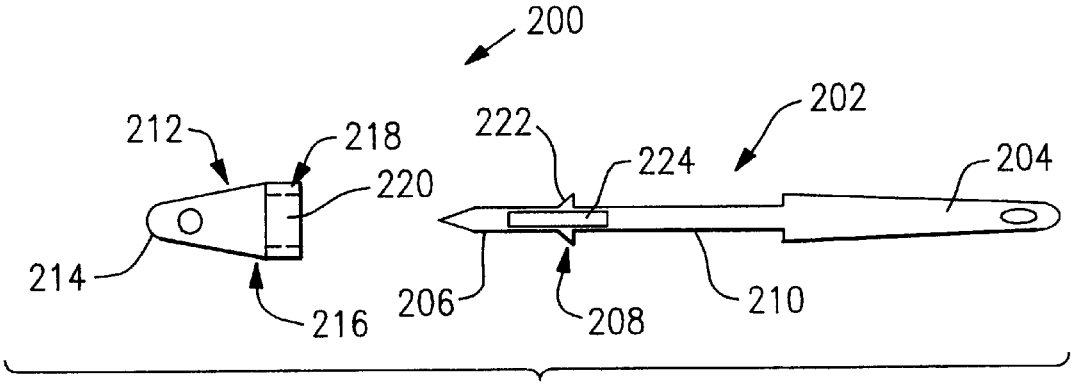
FIG. 11 is a top plan view of a third preferred embodiment of the present invention.
Figure 12:
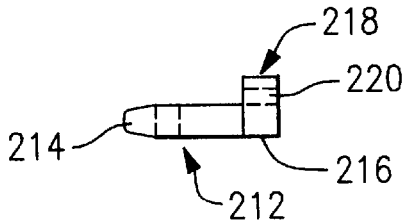
FIG. 12 is a detail side elevation view of the female connector of FIG. 11.

Referring now to FIG. 11, there is illustrated a third preferred embodiment of the present invention, providing a zipper lock 200 which is similar to the first embodiment. There is provided a first extension member 202 having a head 204 and a tail 206 with a male connector 208 and an elongated intermediate portion 210. A second extension member 212 is provided having a head 214 and a body 216 with a female connector 218. The female connector 218 has a channel 220 defined therethrough that receives and engages the male connector 208 of the first extension member 202.

The male connector 208 is formed by at least one and preferably two ribs 222 extending from the tail 206 and a slot 224 defined in the tail 206. The ribs 222 are preferably arranged on opposing sides of the tail 206 with the slot 224 disposed therebetween. The slot 224 allows the male connector 208 to deform into a smaller width upon the application of a force to the ribs 222, so that the male connector 208 may be compressed sufficiently to permit the tail 206 to be extended through the channel 220 of the female connector 218. Each rib 222 preferably has a tapered leading surface for engaging the female connector 218 and receiving a force therefrom as the tail 206 is extended through the channel 220. When the ribs 222 are extended through the channel 220 with the elongated intermediate portion 210 then disposed within the channel 220, the ribs 222 return to their original non-deformed position and thereby act to lock the tail 206 from being retracted through the channel 220 of the female connector 212. The elongated intermediate portion 210, however, remains free to slide within the channel 220.

The third embodiment thus provides generally the same benefits as the first and second embodiments. The third embodiment provides the additional benefit of being generally easier and less costly to manufacture because the deformation provided by the male connector 208 obviates the need for an arm and tab within the female connector and thus allows for the use of a generally smooth bored female connector. It will be understood by those skilled in the art that further alternative embodiments may be provided to accomplish this benefit. For example, a smooth bored female connector may used with a male connector having one or more flexible ribs extending from the upper surface of the tail, a smooth bored female connector may used with a male connector having one or more rigid ribs extending from the upper surface of the tail and having a recess in the lower surface of the tail, or a female connector may be adapted with a tapered inner surface that is capable of engaging the tapered leading surface of the rib.

Figure 13:
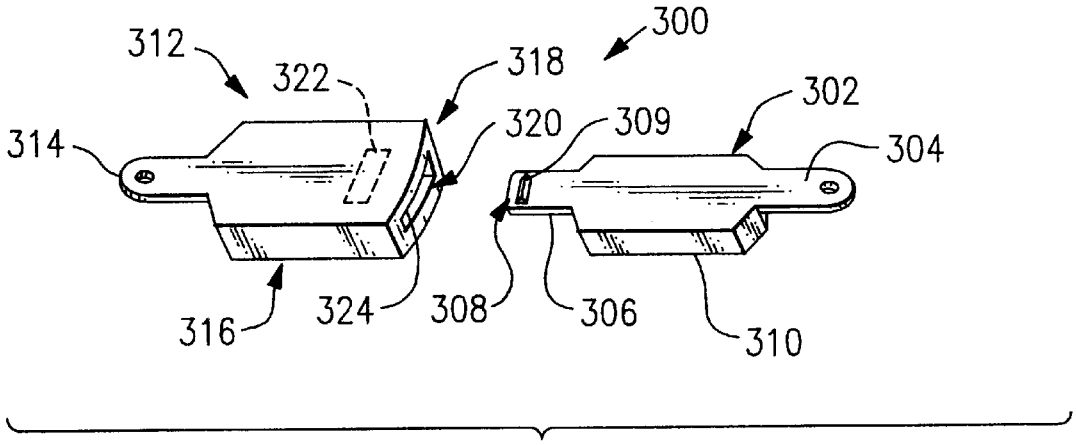
FIG. 13 is a perspective view of a fourth preferred embodiment of the present invention.

Referring now to FIG. 13, there is illustrated a fourth preferred embodiment of the present invention, providing a zipper lock 300 which is similar to the first embodiment. There is provided a first extension member 302 having a head 304 and a tail 306 with a male connector 308 and an intermediate portion 310. The male connector 308 has at least one rib 309 extending therefrom. A second extension member 312 is provided having a head 314 and a body 316 with a female connector 318. The female connector 318 has a channel 320 defined therein that receives the male connector 308 of the first extension member 302. A notch 322 is defined in an interior wall 324 of the channel for receiving and engaging the rib 309 of the male connector 308. The zipper lock 300 of the third embodiment thereby provides first and second extension members 302 and 312 that fixedly lock together to prevent more than a predetermined limited opening of the zipper and accordingly allow some limited access because of the separation of the zipper heads provided by the extension members 302 and 312.

The present invention is used by inserting the male connector 28 into and through the female connector 40 for locking together the first and second extension members 20 and 32. The zipper 12 is then locked from being entirely opened because the female connector 40 will not permit removal of the male connector 28 therefrom.

Because the elongated intermediate portion 30 is generally flat, it may slide freely within the female connector 40 between the head 22 and the male connector 28. The zipper heads 16 and 18 may thus be moved to a generally closed position (see FIG. 1) so that the enclosure 14 may be generally closed during shipping to protect the article contained there from dirt, dust, and other contamination.

Because the male connector 28 is positioned generally at the end of the first extension member 20 and the elongated intermediate portion 30 is generally flat, the zipper heads 16 and 18 may then separated to partially open the enclosure 14 during display (see FIG. 2). In this way, the first and second extension members 20 and 32 act as movable extensions to the zipper 12 to permit freely closing and opening the zipper 12 up to a predetermined range. Thus, the zipper 12 is not locked in any fixed position, but instead permitted to be partially opened or closed but never more than partially opened. The zipper 12 therefore can not be accidentally locked in a closed position preventing the desired limited access to the article within the enclosure 14.

The predetermined range of separation corresponds to the length of the elongated portion 30, and is typically selected so that the zipper heads 16 and 18 may be separated 54 sufficiently to permit portions of the enclosure 14 to be separated 56 sufficiently to form an access opening 58 to the enclosure 14 sufficient to permit a person to enter a hand, finger, or portion of a hand or finger into the enclosure 14 to touch and feel the contents thereof. Furthermore, the length of the elongated portion 30 is selected to provide the access opening 54 sufficiently small so that it is difficult or impossible to insert additional articles into the enclosure 14 for concealment therein. Because of the male and female connectors 20 and 32, the zipper heads 16 and 18 may not be further separated so that the enclosure 14 may not be further opened sufficiently to remove the article therefrom. The enclosure 14 may only be opened further after cutting the elongated portion 30 with a scissors or the like, which if done while in the store to insert additional articles can be easily noticed by store personnel.

Accordingly, there are a number of advantages provided by the present invention. The extension members 20 and 32 with interlocking male and female connectors 28 and 40 provide the advantage of permitting the zipper 12 to be closed during shipping of the enclosure 14 and also permits the zipper 12 to be partially opened and closed yet locked from being more than partially opened during display of the article within the enclosure 14.

Interlockable male and female connectors 28 and 40 are provided on extension members 20 and 32 coupled to the zipper heads 16 and 18, providing the advantage of locking the zipper 12 from being more than partially opened so that the article may not be removed from the enclosure 14 and so that it is difficult or impossible to insert additional articles into the enclosure 14 for concealment therein.

An elongated intermediate portion 30 is provided which may freely slide within the female connector 40, providing the advantage of permitting the zipper heads 16 and 18 to be moved to a generally closed position so that the article within the enclosure 14 is generally protected from dirt, dust, and other contaminants during shipping and storage, and also permitting the zipper heads 16 and 18 to be separated to partially open the enclosure 14 to permit a person to reach in to touch and feel the article therein during display yet locking the zipper 12 from being more than partially opened.

While the invention has been described in connection with certain preferred embodiments, it is not intended to limit the scope of the invention to the particular forms set forth, but, on the contrary, it is intended to cover such alternatives, modifications, and equivalents as may be included within the true spirit and scope of the invention as defined by the appended claims. All patents, applications and publications referred to herein are hereby incorporated by reference in their entirety.

What is claimed is:

1. A locking and extension device, comprising:

a) a zipper having a first head with an eyelet and a second head with an eyelet;

b) a first extension member having a head and a tail, said first extension head having an aperture defined that is coupled to said eyelet of said first zipper head, said tail having a male connector and an elongated intermediate portion disposed between said head and said male connector, said male connector having two ribs extending from opposing sides of said tail and a slot defined through said tail and arranged between said ribs, said elongated intermediate member having a generally flat profile permitting said elongated intermediate member to freely slide within a channel of a female connector; and, c) a second extension member having a head and a body with a female connector, said second extension head having an aperture defined therein that is coupled to said eyelet of said second zipper head, said female connector having a channel defined therethrough, said channel capable of receiving therethrough said male connector and said elongated portion of said tail, wherein said zipper may be freely moved between a generally closed position and a partially opened position yet locked from being more than partially opened.

2. The device of claim 1, wherein said extension first head has a thickness and said second extension head has a thickness that is approximately the same as said thickness of the first extension head.

3. The device of claim 1, wherein said first extension member and said second extension member are made of nylon.

* * * * *